US005189880A

United States Patent [19]

Frossati et al.

[11] Patent Number: 5,189,880

[45] Date of Patent: Mar. 2, 1993

[54] DILUTION REFRIGERATORS

[76] Inventors: Giorgio Frossati, Galgewater 21, 2311 VZ Leiden, Netherlands; Nei F. Oliveira, Jr., Rua José Yázigi 424, CEP 05658 S. Paulo, S.P., Brazil

[21] Appl. No.: 739,988

[22] Filed: Aug. 2, 1991

[30] Foreign Application Priority Data

Aug. 2, 1990 [GB] United Kingdom ..... 9017011

[51] Int. Cl.[5] ..... F25B 19/00

[52] U.S. Cl. ..... 62/51.3

[58] Field of Search ..... 62/51.3

[56] References Cited

U.S. PATENT DOCUMENTS 4,770,006 9/1988 Roach et al. ..... 62/51.3

4,891,951 1/1990 Ishibashi ..... 62/51.3

OTHER PUBLICATIONS

Taconis, K. W.: "Dilution Refrigeration", Cryogenics 1978.

*Primary Examiner*—Ronald C. Capossela

*Attorney, Agent, or Firm*—Wood, Herron & Evans

[57] ABSTRACT

A dilution refrigerator of the type comprising a still and a mixing chamber connected by a heat exchanger is described. The heat exchanger provides a low impedance path between the still and the mixing chamber. All the parts of the dilution refrigerator are made entirely of plastics material.

10 Claims, 1 Drawing Sheet

DILUTION REFRIGERATORS

Figure 1:
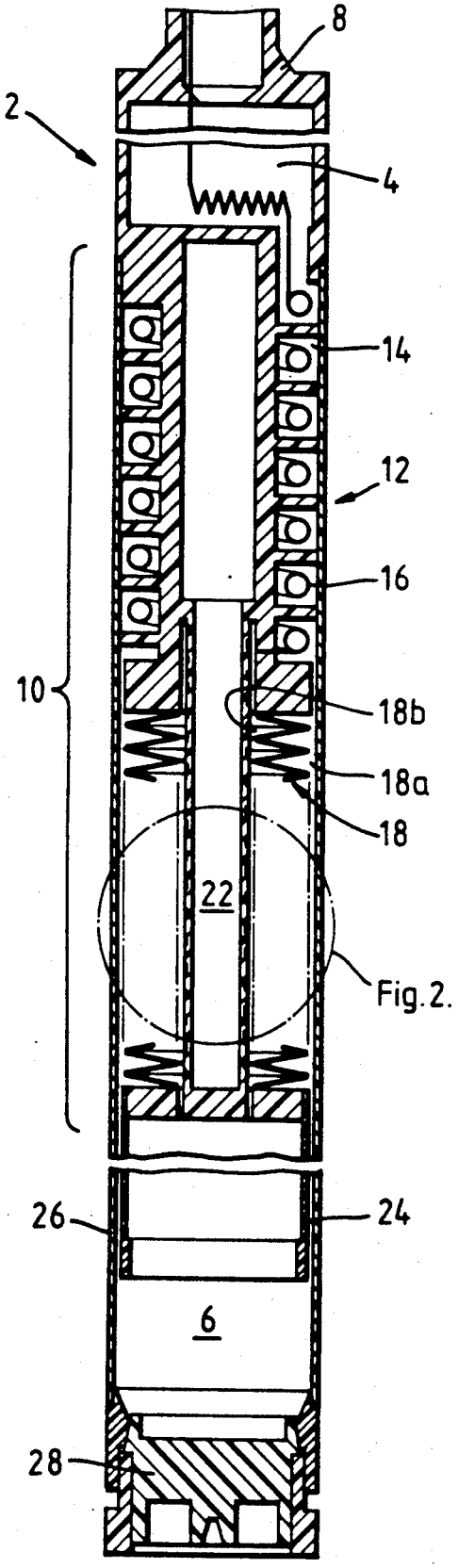

This invention relates to dilution refrigerators, and in particular to dilution refrigerators for use with high magnetic fields.

Dilution refrigerators are presently the most useful means for cooling a sample to a few millikelvin and relies on the expansion of low entropy $He^3$ into a higher entropy mixture of $He^3$ diluted in $He^4$. Such expansion absorbs heat and therefore leads to refrigeration. Helium is the standard coolant for devices working at cryogenic temperatures and liquifies at temperatures below around 4° K.

The dilution refrigerator itself comprises two chambers which are thermally decoupled and connected to each other by means of input and output tubes. The upper chamber is called the distiller (or still for short) and the lower chamber, the mixing chamber. Heat exchange occurs between the fluid passing along the input tube and the fluid passing along the output tube.

Initially, the dilution refrigerator contains a homogeneous mixture of $He^3$ and $He^4$, the temperature of the mixture being around 1.2°–1.5° K. At these temperatures the mixture is homogeneous at all concentrations. The volume of the mixture is calculated completely to fill the input tube, the mixing chamber, the output tube and part of the still.

A low impedance pumping line extends from the still to an external pumping system and subsequently to the input tube to form a closed-cycle circuit. Low pressure gas is pumped from the still, in equilibrium with the free surface of the mixture, and is compressed. As soon as the gas circulation starts, the temperature of the still drops and phase separation occurs. The phase richer in $He^3$, being lighter than the phase richer in $He^4$, floats on top of the $He^4$ and is readily pumped away and recondensed, filling up the input tube and part of the mixing chamber. Since the vapour pressure of $He_4$ is much lower than that of $He^3$, soon only $He^3$ is circulated and the temperature of the still drops to about 0.3 K. At this temperature, the vapour pressure of $He^3$ also becomes very small and the circulation nearly stops, being activated only by the heat leak from the exterior to the dilution refrigerator.

Heat is then applied to the still so as to increase its temperature to 0.6°–0.7° K., where the vapour pressure of $He^4$ is only a few percent of that of $He^3$, and the actual dilution refrigeration starts.

The equilibrium concentration of $He^4$ diluted in $He^3$, at very low temperatures, is essentially zero while that of $He^3$ diluted in $He^4$ is about 6.5%. In the mixing chamber, where concentrated $He^3$ is in equilibrium with diluted $He^3$, if one tries to decrease the limiting concentration of $He^3$ in $He^4$ at a given temperature by pumping, pure $He^3$ will cross the boundary and reestablish the equilibrium concentration. This process absorbs heat and will lower the temperature of the mixing chamber and its content, for example the sample under observation. The enthalpy balance at the mixing chamber gives:

$$Q/n = 94.5\ T^2_{MC} - 12.5\ T^2_C$$

where Q is the cooling power in W, n is the circulation rate in moles/s, $T_{MC}$ is the mixing chamber temperature and $T_C$ is the temperature of the concentrated phase entering the mixing chamber in Kelvin.

The largest cooling power is attained when $T_C = T_{MC}$. This is, in principle, possible with an infinitely large heat exchanger which would transfer all the enthalpy of the incoming concentrated $He^3$ to the outgoing diluted $He^3$. In practice, the maximum cooling power is obtained with a very large area heat exchanger using some convenient material, usually finely divided silver, of large specific area.

The dilution refrigerator therefore has three main blocks: the still on top, the mixing chamber at the bottom, and a heat exchanger, (or set of heat exchangers), in between, arranged to transfer heat from the mixing chamber input tube to the output tube. They are most commonly made of metallic materials, although plastic heat exchangers have been proposed in the past and plastic mixing chambers are known for certain applications.

Many applications of dilution refrigerators require the simultaneous presence of high magnetic fields with low temperatures.

Intense dc magnetic fields are normally produced by superconducting solenoids, resistive solenoids of the Bitter type, or a combination of both (hybrid magnets). In the presence of an intense magnetic field, the lowest temperature of a dilution refrigerator will be limited by the eddy-current heating caused by field fluctuations and mechanical vibrations.

The field produced by a superconducting solenoid can be very quiet, especially when the solenoid is provided with a persistent mode switch, and the eddy-current heating can be kept reasonably small by carefully minimising mechanical vibrations. The field of Bitter magnets, however, is inherently 'noisy' which severely limits the minimum temperature of a dilution refrigerator. Unfortunately, Bitter magnets are most suitable for the production of the highest fields. In any case, cooling samples in intense fields by means of a dilution refrigerator always involves long cool down times due to the large distances between the sample and the rest of the dilution refrigerator. For the same reason, changing the field is always a time consuming operation as it results in eddy currents heating the metallic parts of the refrigerator.

To minimize the eddy-current heating effect it is important to avoid as much as possible the presence of highly conductive materials in the region of the intense fields. Two approaches are most commonly used. The first is to have the dilution refrigerator placed outside the region of intense field, but provided with a long epoxy mixing chamber that extends into the centre of the magnet bore. The second is to have a large heat exchanger inside the metallic mixing chamber (placed outside the field) connected to a cold finger that extends into the field region. The cold finger is typically a silver rod provided with slits to decrease the eddy-current heating.

A dilution refrigerator in accordance with the invention comprises a still and a mixing chamber, the two being connected together by a heat exchanger providing a low impedance path, the whole being made entirely of plastics material.

The fully plastics construction of such a dilution refrigerator eliminates the problems of eddy-current heating. The heat exchanger may be tubular or in the form of a bellows or preferably a combination of both, in series. The bellows configuration provides a very large surface area whilst also providing a relatively low impedance path.

The tubular heat exchanger preferably comprises a rod having a spiral groove extending from one end to the other. This groove may hold at least one plastic capillary. The concentrated $He^3$ mixture from the still passes down one capillary towards the mixing chamber. The returning diluted $He^3$ mixture may either pass up another capillary, preferably situated exterior to the former capillary, or pass up the spiral groove around the capillary.

Preferably the 'output' tube of the heat exchanger, for transportation of the diluted $He^3$ away from the mixing chamber, is located exterior to the 'input' tube, for the transportation of the concentrated $He^3$ to the mixing chamber. The diluted $He^3$, which absorbs heat from the concentrated $He^3$, therefore acts as a heat shield, to prevent heat from outside of the refrigerator reaching the cold input tube.

When the bellows configuration is used, it is desirable to provide a rod, having a spiral groove, down the centre of the bellows. The rod ideally fits snugly within the central hole. The spiral groove provides a low impedance and low thermal conductivity between the still and the mixing chamber and also a fairly long residence time for the $He^3$ within the bellows. The inside of the bellows needs sufficient surface area to transmit heat into the folds of the bellows through the stagnant $He^3$ mixture which sits in the bellows and around the rod.

The viscosity of the $He^3$–$He^4$ mixture is high and the provision of an 'easy' low impedance path through the heat exchanger will reduce viscous heating. The conductivity of the liquid is high, so heat is easily carried to all stagnant parts of the liquid in the exchanger. At very low temperatures, heat tends to be reflected at all boundaries (the Kapitza resistance), so very large areas are required.

Preferably the plastic walls of the heat exchanger are relatively thin to improve the thermal transfer. Plastic walls have a lower Kapitza resistance than metal walls.

The still, heat exchanger and mixing chamber are preferably enclosed by a plastics tube which extends from the still to the mixing chamber. There are therefore only two joins which need to be leaktight to prevent leakage from the refrigerator to the surrounding space. This is an important advantage of a dilution refrigerator which is to operate in a high vacuum enclosure.

Figure 2:
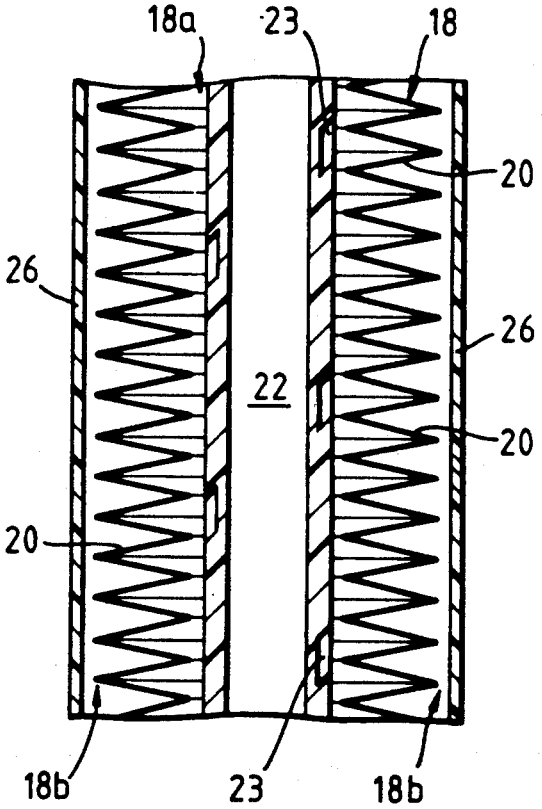

The invention will now be described further, by way of example, with reference to the accompanying drawings, in which:

FIG. 1 is a longitudinal cross section of a dilution refrigerator according to the invention and FIG. 2 shows, on an enlarged scale, a section of a heat exchanger for use in the dilution refrigerator of FIG. 1.

A dilution refrigerator generally indicated at 2 has a still 4 and a mixing chamber 6. The still is machined out of Araldite and is approximately 65 mm in length. A film breaker 8 is provided at the top of the still to prevent a film of $He^4$ (which acts as a superfluid at the operating temperature of the dilution refrigerator) escaping from the still.

The still 4 is connected to a heat exchanger 10 which provides thermal insulation between the still and the mixing chamber. The heat exchanger has two sections in series. The top section is a continuous counterflow tubular heat exchanger 12 made from an Araldite rod in which a spiral groove 14 has been milled. The total length of the rod is approximately 41 cm. A Teflon TM capillary 16 approximately 6 m long, is placed within the groove but does not occupy the entire cross-sectional area, so that fluid may be conducted along the groove, exterior to the capillary. The $He^3$-rich condensed phase passes through the capillary 16 towards the mixing chamber, whilst the outgoing $He^3$-diluted phase is conducted along the spiral groove 14 to the still. Both the groove 14 and the capillary 16 provide a low impedance path for the $He^3$ mixtures. However, the path is of such a length to cause the $He^3$ mixtures to reside with the tubular heat exchanger 12 for a sufficient period of time to allow sufficient heat exchange to occur.

The bottom section of the heat exchanger 10 comprises a bellows 18 (FIG. 2) made of plastic foils, which separates the concentrated mixture emitted from the capillary 16 from the dilute mixture emitted from the mixing chamber. The concentrated mixture passes down the capillary 16 and the inside of the bellows 18 in to the mixing chamber and the diluted mixture passes up the outside of the bellows **18*b* and along the groove 14 to the still. The bellows is formed by gluing together alternately the inner and outer circumferences of approximately 600 annular discs 20. An Araldite rod 22, having a spiral groove 23**, extends within the bellows and occupies substantially all the central hole of the discs, as shown in FIG. 2.

The spiral groove 23 provides a low impedance and low thermal conductivity between the still 4 and the mixing chamber 6 and also a fairly long residence time for the $H^3$ within the bellows 18. The inside **18*a* of the bellows provides sufficient surface area to transmit heat into the folds of the bellows through the stagnant $He^3$ mixture which sits in the bellows and around the rod 22**.

The tubular heat exchanger 12 and rod 22 may be hollow (as shown) or solid. They may further be integrally formed (as shown) or they may be separate parts.

A cylindrical plastic shield 24 is attached to the bottom of the full heat exchanger, providing space for the phase boundary. $He^3$ is then pumped away along a path external to the shield.

The heat exchanger 10 is enclosed by a tight fitting plastic cylinder 26 which covers all parts of the refrigerator below the still. The wall of the mixing chamber 6 is formed by the bottom of this cylinder and the bottom of the mixing chamber is closed by a conical plug 28 on which an experimental cell can be placed.

Such a dilution refrigerator 2 is capable of obtaining temperatures in the region of 10 mK at a rate of circulation of the $He^3$ of typically 270 $\mu$moles/s but up to 1000 $\mu$moles/s. However, lower temperatures are expected to be achieved. The outside diameter of the dilution refrigerator shown is 36 mm, including the outer plastic cylinder 26. This means that the entire refrigerator can be placed in the bore of most existing magnets, including Bitter magnets.

This small refrigerator has circulation rates and therefore cooling powers 10 to 100 times greater than a metal refrigerator of the same size and in addition does not suffer from eddy-current heating. Also a high power metal refrigerator of this cooling power is expensive to manufacture with sintered silver powder and many connections and joints.

We claim:

1. A dilution refrigerator comprising:

a plastic still having a film breaker at an upper end thereof;

a plastic heat exchanger structure in fluidic communication with said still at an upper end of said heat exchanger; and a mixing chamber defined by plastic walls, said mixing chamber in fluidic communication with said heat exchanger structure at a lower end of said heat exchanger, said heat exchanger providing a relatively low impedance path for fluid flow between said still and said mixing chamber.

2. A dilution refrigerator as claimed in claim 1, wherein said heat exchanger structure is in the form of a bellow.

3. A dilution refrigerator as claimed in claim 1, wherein said heat exchanger is tubular.

4. A dilution refrigerator as claimed in claim 1, wherein said tubular heat exchanger comprises a rod having a spiral groove along the length thereof.

5. A dilution refrigerator as claimed in claim 3 or claim 4, wherein the tubular form heat exchanger comprises a rod having a spiral groove extending from one end of the rod to the other end thereof.

6. A dilution refrigerator as claimed in claim 5, wherein at least one plastic capillary is held within the spiral groove.

7. A dilution refrigerator as claimed in claim 1, wherein said heat exchanger structure has an output tube for transportation of diluted $He^3$ away from said mixing chamber and an input tube for transportation of concentrated $He^3$ to said mixing chamber, said output tube being located externally of said input tube.

8. A dilution refrigerator as claimed in claim 2 or 4, wherein a rod having a spiral groove is provided down the centre of said bellows.

9. A dilution refrigerator as claimed in claim 1, wherein said still, heat exchanger structure and mixing chamber are enclosed by a plastic tube which extends from said till to said mixing chamber.

10. A dilution refrigerator as claimed in claim 1, wherein said heat exchanger structure has walls of relatively thin plastic.

* * * * *